US006974339B2

(12) United States Patent
Kuzmenka

(10) Patent No.: US 6,974,339 B2
(45) Date of Patent: Dec. 13, 2005

(54) CONNECTOR

(75) Inventor: Maksim Kuzmenka, Munich (DE)

(73) Assignee: Infineon Technologies AG, Munich (DE)

( * ) Notice: Subject to any disclaimer, the term of this patent is extended or adjusted under 35 U.S.C. 154(b) by 0 days.

(21) Appl. No.: 10/901,934

(22) Filed: Jul. 28, 2004

(65) Prior Publication Data

US 2005/0059300 A1 Mar. 17, 2005

(30) Foreign Application Priority Data

Jul. 28, 2003 (EP) ..... 03017094

(51) Int. Cl.[7] ..... H01R 13/20

(52) U.S. Cl. ..... 439/161

(58) Field of Search ..... 439/161

(56) References Cited

U.S. PATENT DOCUMENTS

| | | | | |
|---|---|---|---|---|
| 3,569,901 | A * | 3/1971 | Connor | 439/161 |
| 4,734,047 | A | 3/1988 | Krumme | |
| 4,846,729 | A | 7/1989 | Hikami et al. | |
| 4,952,162 | A * | 8/1990 | Hikami et al. | 439/161 |
| 5,090,116 | A | 2/1992 | Henschen et al. | |
| 5,092,781 | A | 3/1992 | Casciotti et al. | |
| 6,565,367 | B2 * | 5/2003 | Budman et al. | 439/82 |

* cited by examiner

*Primary Examiner*—Ross Gushi
(74) *Attorney, Agent, or Firm*—Slater & Matsil, L.L.P.

(57) ABSTRACT

A connector has a connector body, at least one contact and at least one bimetal stripe. One end of the contact is fixed to the connector body and another end of each contact extends from a surface of the connector body forming a springy contact. One end of the bimetal stripe is fixed in the connector body and another end of the bimetal stripe extends from the surface of the connector body. The bimetal stripe is arranged for moving the contact in a first or second position depending on the temperature of the bimetal stripe.

16 Claims, 3 Drawing Sheets

CONNECTOR

CROSS-REFERENCE TO RELATED APPLICATION

This application claims priority from European Patent Application No. 03017094.8, which was filed on Jul. 28, 2003, and is incorporated herein by reference in its entirety.

BACKGROUND OF THE INVENTION

1. Field of the Invention

The present invention relates to a connector and, in particular, to a connector used in the field of electric circuit modules for a board to board or cable to board connection.

2. Description of the Related Art

Conventional connectors used in the field of electrical circuit modules for board to board or cable to board connections comprise two connector parts. Each connector part is mounted on a board or fixed to a cable and provides an electrical connection to the board or cable. At a plug-in side, each connector part comprises electrical contacts. An electrical and mechanical connection is achieved, by plugging the two connector parts together, such that the electrical contacts of the connector parts come together. To keep the connection, a connection force is necessary. There are two different ways to generate the connection force.

Zero insertion force (ZIF; ZIF=zero insertion force) connectors do not require a plug-in force to plug the two connector parts together. The necessary connection force is achieved by a mechanical scheme with toggles or screws. This complicated mechanical scheme to provide the connection force results in high costs and makes the connector difficult to handle. To protect the electrical contacts against corrosion, expensive contact materials, like gold are required.

Another type of connector requires a plug-in force to plug the two connector parts tight together. This tight connection results in a continuing connection force which keeps the two connector parts together. Besides the need for protection against corrosion, this connector type has the disadvantage that the connection force is very small and therefore the connector is sensitive to vibrations. This implies a low reliability of the connection.

SUMMARY OF THE INVENTION

It is the object of the present invention to provide a connector that allows a reliable connection.

In accordance with a first aspect, the present invention provides a connector having: a connector body; at least one contact; and at least one bimetallic stripe, wherein one end of the contact is fixed to the connector body and another end of each contact extends from a surface of the connector body forming a springy contact, wherein one end of the bimetallic stripe is fixed in the connector body and another end of the bimetallic stripe extends from the surface of the connector body, and wherein the bimetallic stripe is arranged for moving the contact in a first or second position depending on the temperature of the bimetallic stripe.

The invention is based on the finding that a bimetal stripe can be used as part of a connector, to provide a strong connection force.

According to the present invention a folded bimetal stripe is arranged adjacent to a springy contact of a connector and configured to push against the springy contact or release the springy contact, depending on the temperature. When pushing against the springy contact, the bimetal stripe generates a connection force between the springy contact and a contact of a second connector part which is plugged into the connector.

In a first embodiment the second connector part is fixed by the springy contact at a low temperature and released at a high temperature of the bimetal stripe.

In another embodiment, the second connector part is fixed by the springy contact at a high temperature and released at a low temperature of the bimetal stripe. In this embodiment, the second connector part comprises a soldered contact that establishes a soldered connection between the contact of the connector and the contact of the second connector part. A soldered connection provides high resistance against vibrations, mechanical stress and an aggressive chemical environment and does not require expensive contact materials.

In a further embodiment, the bimetal stripe is heated by way of a current which is supplied to the bimetal stripe. This allows an easy handling of the connector. By connecting the bimetal stripe to an electrical ground, the bimetal stripe further provides a protection against electromagnetic interferences.

BRIEF DESCRIPTION OF THE DRAWINGS

Preferred embodiments of the present invention are described hereinafter, making reference to the appended drawings.

DESCRIPTION OF PREFERRED EMBODIMENTS

Figure 1A:
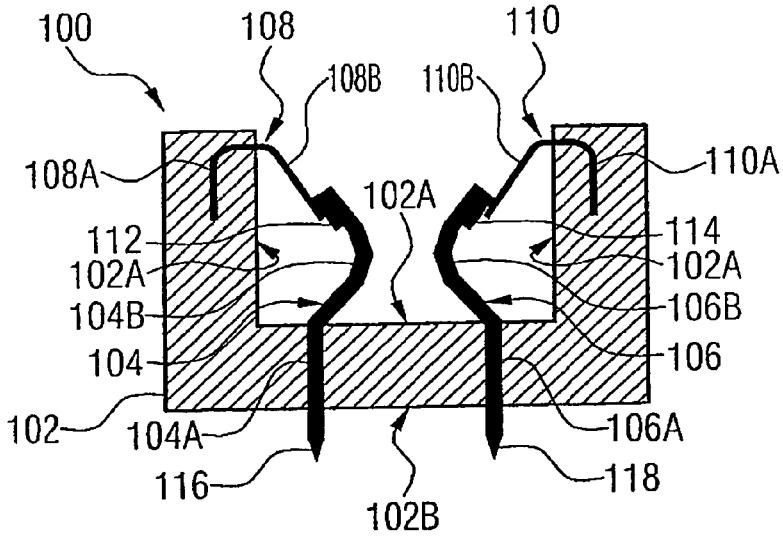
FIGS. 1*a,* 1*b,* 1*c* show a schematic view of a connector embodying the present invention, in three states of an engagement process.

FIGS. 1*a,* 1*b,* and 1*c* show an embodiment of a connector according to the present invention in three different states of an engagement process.

FIG. 1*a* shows a connector 100 which comprises a connector body 102, a first contact 104 and a second contact 106, a first bimetal stripe 108 and a second bimetal stripe 110. In the illustrated embodiment, the connector body 102 has a shape like a "U" and comprises a first surface 102*a* which covers an inner side and a second surface 102*b* covers an outer side of the connector body 102.

One end 104*a,* 106*a* of each contact 104, 106 is fixed in the connector body. The other end 104*b,* 106*b* of each contact 104, 106 forms a springy contact and extends from the first surface 102*a* of the connector body 102. The springy contacts 104*b* and 106*b* are arranged such that they form a gap in between.

One end 108*a,* 110*a* of each bimetal stripe 108 and 110 is fixed to the connector body 102 and a free end 108*b,* 110*b* of each bimetal stripe 108, 110 extends from the first surface 102*a*. The free ends 108*b,* 110*b* of the bimetal stripes 108, 110 are formed such that they press against the springy contacts 104*b*, 106*b* and comprise dielectric stripes 112, 114 which are arranged such that they form a barrier between the springy contacts 104*b*, 106*b* and the free ends 108*b*, 110*b* of the bimetal stripes. Thus, the dielectric stripes 112, 114 provide an electric isolation between the contacts 104, 106 and the bimetal stripes 108, 110.

Typically, the connector 100 is arranged on a circuit board (not shown). In order to connect the connector 100 to the circuit board, the fixed ends 104*a*, 106*a* of the contacts 104, 106 extend from the second surface 102*b* of the connector body 102 and form terminals 116, 118.

The bimetal stripes 108, 110 comprise two layers (not shown in the figures) of different metals which have different coefficients of thermal expansion. Thus, the two different metal layers have a different expansion at given temperatures. As the two different metal layers are fixed together, the bimetal stripe changes its form while being exposed to different temperatures to compensate for the different expansions of the two metal layers.

In this embodiment, each bimetal stripe 108, 110 bends towards the adjacent contact 104, 106 and presses against it, when it is exposed to a temperature which is in the range of an operating temperature of an application for which the connector 100 is used. FIG. 1 shows the connector 100 in such a state, in which the bimetal stripes 108, 110 have a temperature which is in the range of the operating temperature. The bimetal stripes 108, 110 press against the springy contacts 104*b*, 106*b* and move them into a first position. In this first position, the gap between the springy contacts 104*b*, 106*b* is not wide enough for receiving a second connector part (not shown in FIG. 1).

Figure 1B:
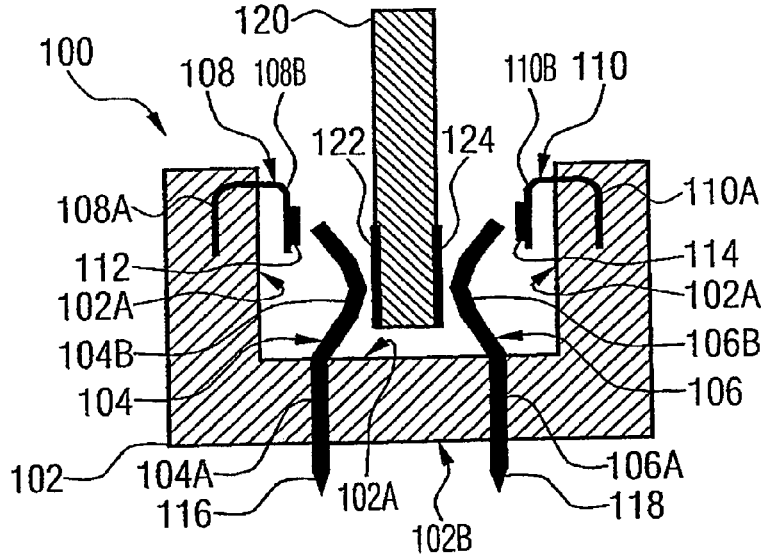

FIG. 1*b* shows the connector 100 as illustrated in FIG. 1*a*, with the springy contacts 104*b*, 106*b* being in a second position, in which it is possible to plug a second connector part 120 into the gap between the springy contacts 104*b*, 106*b*. The second connector part 120 comprises two contacts 122, 124 which are arranged such that they can engage with the contacts 104, 106 when the second connector part 120 is plugged into the connector 100 and the contacts 104, 106 are moved back to first position.

The second connector part 120 may be a second connector that connects to a cable or may be a printed circuit board like a memory module.

In the state shown in FIG. 1*b*, the bimetal stripes 108, 110 are heated up to a high temperature that is above of the operating temperature. At this temperature the bimetal stripes 108, 110 bend away from the contacts 104, 106. Thus, the pressure on the springy contacts 104, 106 is reduced and the springy contacts 104*b*, 106*b* relax. The gap between the contacts 104, 106 widens and is wide enough for receiving the second connector part 120.

After the second connector part 120 is plugged into the connector 100, the temperature of the bimetal stripes 108, 110 is lowered again. Thus, the bimetal stripes 108, 110 again change their form and press against the springy contacts 104*b*, 106*b*.

Figure 1C:
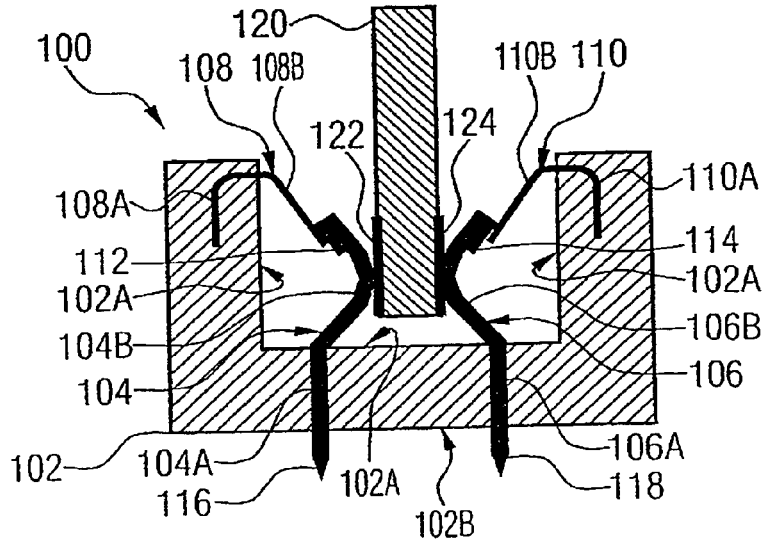

FIG. 1*c* shows the connector 100 with the second connector part 120 plugged into the gap between the contacts 104, 106 that are moved back into the first position. In this state, the bimetal stripes 108, 110 have a temperature which is again within the range of the operating temperature. Thus, the bimetal stripes 108, 110 press against the springy contacts 104*b*, 106*b*, thereby reducing the width of the gap between the contacts 104, 106. The springy contacts 104*b*, 106*b* are pressed against the contacts 122, 124 of the second connector part 120. An electrical connection is formed between the contacts 104, 106 of the connector 100 and the contacts 122, 124 of the second connector part 120. Additionally to the electrical connection, the second connector part 120 is mechanically fixed to the connector 100.

To disconnect the second connector part 120 from the connector 100, the bimetal stripes 108, 110 are heated up again. Thus, the contacts 104, 106 move into the second position and the second connector part 120 can be taken out of the connector 100.

Figure 2A:
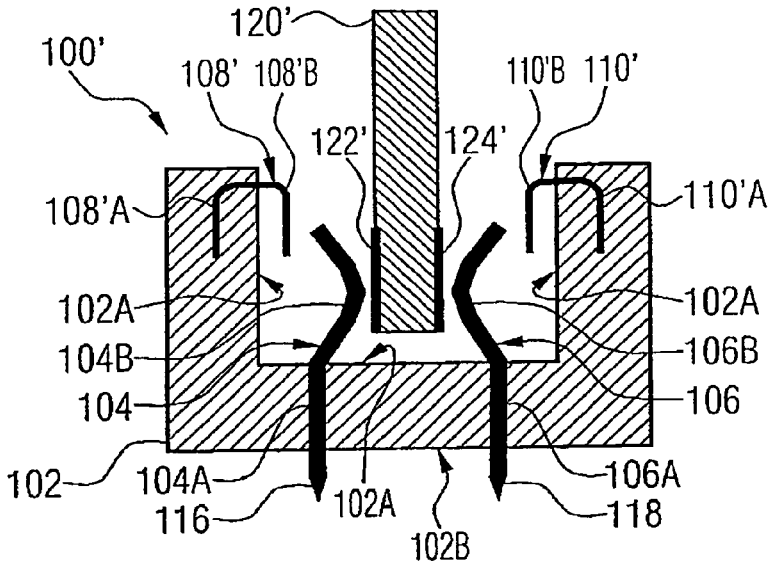
FIGS. 2*a,* 2*b,* 2*c* show a schematic view of a connector according to a further preferred embodiment, in three states of an engagement process.
Figure 2B:
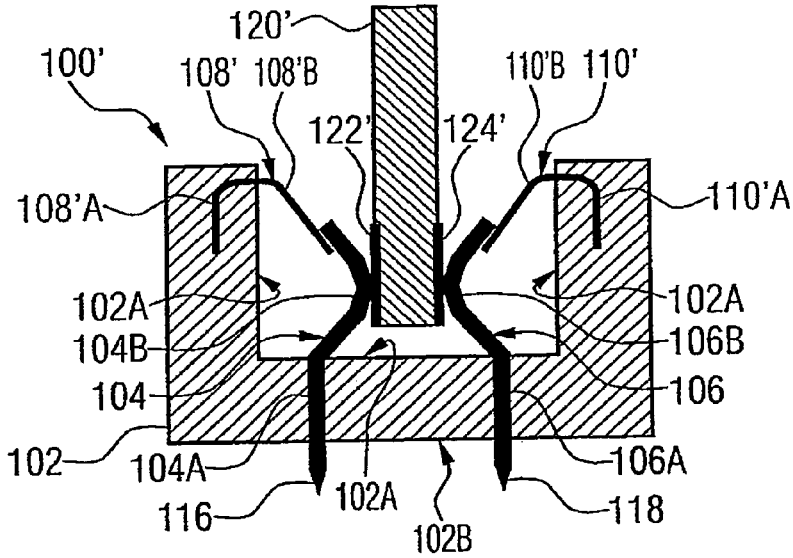
Figure 2C:
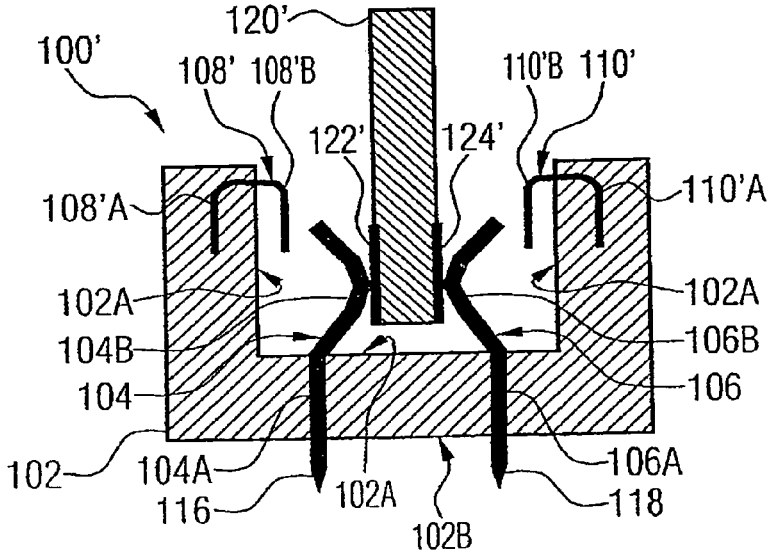

FIGS. 2*a*, 2*b*, and 2*c* show a connector 100' according to a further preferred embodiment of the present invention, in three different states of an engagement process.

Components of the connector 100' which are shown in the FIGS. 2*a*, 2*b* or 2*c* which correspond to components shown in the FIGS. 1*a*, 1*b* or 1*c* have the same reference numbers and are not further explained hereinafter.

FIG. 2*a* shows a connector 100' which comprises two springy contacts 104*b*, 106*b* which are arranged according to FIG. 1*a* and form a gap in between. The connector 100' further comprises two bimetal stripes 108', 110'. The bimetal stripes 108', 110' again have a fixed end 108'*a*, 110'*a* which is fixed to the connector body 102 and a free end 108'*b*, 110'*b* which extends from the surface 102*a* of the connector body 102. A second connector part 120' is plugged into the gap between the springy contacts 104*b*, 106*b*. The second connector part 120' comprises two contacts 122', 124'.

In the state shown in FIG. 2*a*, the bimetal stripes 108', 110' have a temperature which is in the range of an operating temperature. In this embodiment, the bimetal stripes 108', 110' bend away from the contacts 104, 106, at this low temperature. Thus, the springy contacts 104*b*, 106*b* are in a relaxed position, or a second position. In this second position, the gap between the contacts 104, 106 is wide enough for receiving the second connector part 120'.

FIG. 2*b* shows the connector 100' in a state, in which the bimetal stripes 108', 110' have a high temperature which is above the operating temperature. At this high temperature, the bimetal stripes 108', 110' bend towards the contacts 104, 106 and the contacts 104, 106 are moved into a first position. Thus, the springy contacts 104'*b*, 106'*b* are pressed against the second connector part 120' which is arranged in the gap between the contacts 104, 106.

The second connector part 120' comprises contacts 122', 124' which are as described with reference to FIG. 1*b*. The contacts 122', 124' are soldered contacts which comprise a layer of solder (not shown), on a surface which is adjacent to the contacts 104, 106. In this embodiment, the high temperature which is necessary to deform the bimetal stripes 108', 110' has a second function. When the heated bimetal stripes 108', 110' press against the contacts 104, 106, the same allow the propagation of heat to the springy contacts 104*b*, 106*b* which allow the further propagation of heat to the soldered contacts 122', 124' of the second connector part 120'. The soldered contacts 122', 124' heat up and the solder on the soldered contacts 122', 124' melts, and connects the soldered contacts 122', 124' to the springy contacts 104*b*, 106*b*.

It is preferred that the temperature which is necessary to melt the solder on the soldered contacts 122', 124' is higher than the temperature which is necessary to press the bimetal stripes 108', 110' against the contacts 104, 106. Thus, it is guaranteed that the contacts 104, 106 maintain their soldered connection to the soldered contacts 122', 124' while the bimetal stripes 108', 110' are cooling down because the solder solidifies before the bimetal stripes 108', 110' bent away from the contacts 104, 106.

FIG. 2*c* shows the connector 100' in a state in which the bimetal stripes 108', 110' are cooled down again to a temperature which is in the range of the operating temperature. In this state there is no contact between the bimetal stripes 108', 110' and the contacts 104, 106. However, there is still an electrical and mechanical connection between the connector 100' and the second connector part 120', as the contacts 104, 106 are soldered to the soldered contacts 122', 124' of the second connector part 120'.

To disconnect the second connector part 120' from the connector 100', the bimetal stripes 108', 110' are heated up again to the high temperature. In this state, the second connector 120' can be disconnected from the connector 100', as the solder is melted again. The process of soldering and de-soldering can be repeated multiple times.

Figure 3:
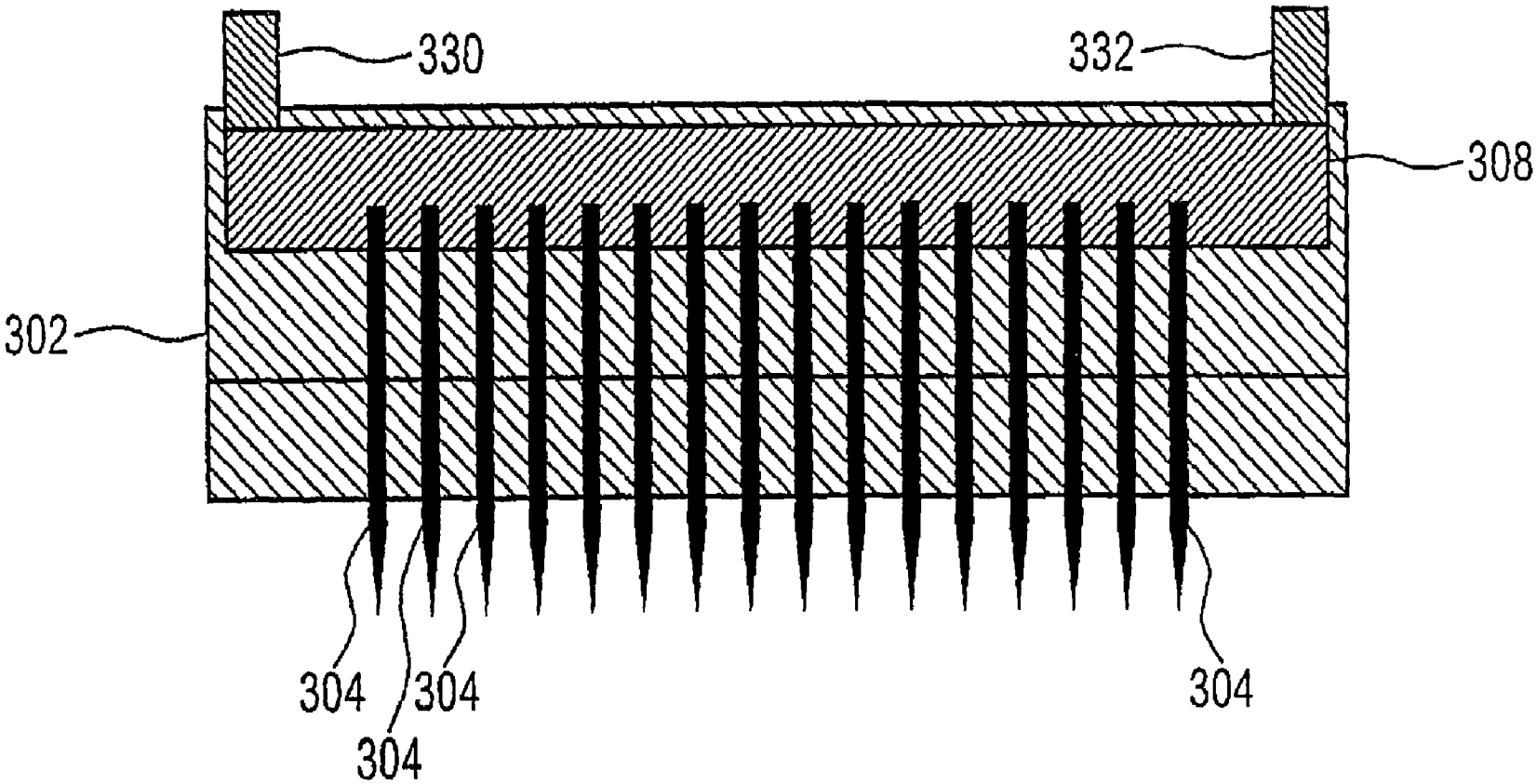
FIG. 3 shows a schematic view of another preferred embodiment of the present invention.

FIG. 3 shows a schematic view through the long side of a connector 300 according to a further preferred embodiment of the present invention. The connector 300 comprises a connector body 302, a plurality of contacts 304 and a bimetal stripe 308. The bimetal stripe 308 can be arranged adjacent to the contacts 304, as described with reference to FIG. 1*a* or FIG. 2*a*. In this embodiment, the bimetal stripe 308 comprises two supply contacts 330, 332. At each end of the bimetal stripe 308 one of the supply contacts 330, 332 is arranged such that the supply contacts 330, 332 extend from the connector body 302, such that clamps (not shown) to supply a current to the bimetal stripe 308 can be attached. According to this embodiment, the high temperature which is necessary to deform the bimetal stripe 308 and to melt the solder as described with reference to the embodiment of FIG. 2, is generated by supplying a current to the bimetal stripe 308 via the supply contacts 330, 332. The current flows through the bimetal stripe 308, thereby heating it up.

According to a further embodiment, the bimetal stripe comprises a further contact for contacting the bimetal stripe to an electrical ground. Thus, the bimetal stripe provides a protection against electromagnetic interferences for the connector.

Furthermore, the form of the connector body is not limited to the form shown in the embodiments, but may have any form which is useful for an application the connector is intended for. The same is true for the number and arrangement of contacts, soldered contacts and bimetal stripes of the connector and the number and arrangement of second connector parts which are to be engaged with the connector.

Besides supplying a current to the bimetal stripe to heat it up, as described in FIG. 3, the high temperature can be achieved by exposing the connector to high temperature or heat the bimetal stripes in any other way.

Furthermore the deformation of the bimetal stripes can be achieved by exposing the connector to a temperature below an operating temperature.

While this invention has been described in terms of several preferred embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

What is claimed is:

1. A connector comprising:

a connector body; and at least one contact; and at least one bimetal stripe;

wherein one end of the contact is fixed to the connector body and another end of each contact extends from a surface of the connector body forming a springy contact;

wherein one end of the bimetal stripe is fixed in the connector body and another end of the bimetal stripe extends from the surface of the connector body; and wherein the bimetal stripe is arranged for moving the contact in a first or second position depending on the temperature of the bimetal stripe; and wherein the first position corresponds to a position in which the contact engages with a second connector part which is plugged into the connector and wherein the second position corresponds to a position in which the contact releases the second connector part; and wherein the second connector part comprises at least one contact that engages with the contact of the connector and wherein at least one of the contacts is a soldered contact, and wherein the contact maintains in the first position on a transition from high to low temperature.

2. The connector according to claim 1, wherein the end of the contact extends from a second surface of the connector body and forms a terminal.

3. The connector according to claim 1, wherein the bimetal stripe comprises a dielectric stripe for preventing direct contact between the contact and the bimetal stripes.

4. The connector according to claim 1, further comprising:

at least one pair of contacts; and at least one pair of bimetal stripes;

wherein the contacts are arranged on the surface of the connector body such that a gap is formed between the contacts, and wherein the pair of bimetal stripes is arranged in parallel to the gap formed by the contacts and the contacts are arranged between the bimetal stripes.

5. The connector according to claim 1, wherein the bimetal stripe comprises a first and a second supply contact for supplying a current for heating up the bimetal stripe.

6. The connector according to claim 1, wherein the contacts are electrical contacts.

7. The connector according to claim 1, wherein the second connector part is a circuit board.

8. The connector according to claim 1, wherein each bimetal stripe further comprises a ground contact for connecting the bimetal stripe to an electrical ground.

9. A method of electrically connecting contacts, the method comprising:

providing a first connector that includes a first contact and a bimetal stripe that are fixed to a connector body, the first contact being in a first position at a first temperature;

locating a second contact adjacent the first contact such that solder is located between the first contact and the second contact; and heating the first contact and the bimetal stripe such that the bimetal stripe changes shape causing the first contact to be moved into a second position that pushes against the second contact, the heating also causing the solder to melt and create an electrical connection between the first contact and the second contact.

10. The method of claim 9, wherein heating the first contact and the bimetal stripe comprises running a current through the bimetal stripe.

11. The method of claim 9, further comprising electrically coupling the bimetal stripe to a ground connection.

12. The method of claim 9, wherein the second contact is part of a printed circuit board.

13. The method of claim 9, further comprising allowing the first contact and the bimetal stripe to cool after the heating, wherein the first contact remains in the second position after the bimetal stripe cools.

14. The method of claim 13, wherein the bimetal stripe changes shape back to an original position after the bimetal stripe cools.

15. The method of claim 13, further comprising reheating the first contact and the second contact such that the solder melts.

16. The method of claim 15, further comprising moving the second contact away from the first contact.

* * * * *